US005473787A

United States Patent [19]

Echols

[11] Patent Number: 5,473,787

[45] Date of Patent: Dec. 12, 1995

[54] METHOD AND APPARATUS FOR CLEANING TUBES OF HEAT EXCHANGERS

[75] Inventor: James F. Echols, Bellaire, Tex.

[73] Assignee: Betz Laboratories, Inc., Trevose, Pa.

[21] Appl. No.: 262,855

[22] Filed: Jun. 21, 1994

[51] Int. Cl.[6] ..... B08B 9/04; F28G 1/00

[52] U.S. Cl. ..... 15/104.061; 165/95

[58] Field of Search ..... 165/95; 15/3.5, 15/3.51, 104.061, 104.062

[56] References Cited

U.S. PATENT DOCUMENTS

| | | | |
|---|---|---|---|
| 2,801,824 | 8/1957 | Taprogge | 165/95 |
| 3,021,117 | 2/1962 | Taprogge | 165/95 |
| 3,100,534 | 8/1963 | Herndon, Jr. et al. | 15/109.061 X |
| 3,269,543 | 8/1966 | Treplin | 210/316 |
| 3,939,519 | 2/1976 | Muirhead | 15/104.061 |
| 4,113,008 | 9/1978 | Treplin et al. | 165/95 |
| 4,135,574 | 1/1979 | Treplin et al. | 165/95 |
| 4,283,807 | 8/1981 | Bizard | 15/3.51 |
| 4,304,295 | 12/1981 | Otake | 165/95 |
| 4,350,202 | 9/1982 | Schultz et al. | 165/95 |
| 4,523,634 | 6/1985 | Bizard | 165/95 |
| 4,550,466 | 11/1985 | Schmitz | 15/104.061 |
| 4,569,097 | 2/1986 | Echols | 15/104.061 |
| 5,010,950 | 4/1991 | Voith | 165/95 |
| 5,083,606 | 1/1992 | Brown et al. | 165/11.1 |
| 5,127,125 | 7/1992 | Skibowski | 15/104.061 |
| 5,153,963 | 10/1992 | Saxon et al. | 15/104.061 |

FOREIGN PATENT DOCUMENTS

| | | | |
|---|---|---|---|
| 211180 | 9/1960 | Germany | 15/104.061 |
| 3818246 | 12/1989 | Germany | 15/104.061 |
| 1586801 | 8/1990 | U.S.S.R. | 15/104.061 |
| 336388 | 10/1930 | United Kingdom | 15/104.061 |

OTHER PUBLICATIONS

J. R. Pritchard, "A New Approach to On–Line Mechanical Condenser Tube Cleaning", Sep. 1993.

Author Unknown, "On–Line Mechanical Tube Cleaning For Open Cooling Water Systems" Sidtec, Jul 1988.

Brochure "Break–Through Technology For Tube Cleaners", Sidtec, Date Unknown.

S. D. Strauss, "Condenser–biofouling control looms large in light of toxic–discharge deadline," *Power*, pp. 83–85, Sep. 1985.

T. O. Holderer et al., "The Effects of Condenser Biofouling on Plant Performance." Date Unknown.

James K. Rice, "Discharge Regulations Affecting Biofouling Control." Date Unknown.

Robert Bell, et al., "State–of–the–Art Mechanical Systems for Scale and Biofilm Control", Date Unknown.

K. E. Atwood, "Cost Impact of Condenser Fouling," *Condenser Biofouling Control*, pp. 42–45, Date Unknown.

J. F. Garey, et al., *Condenser Biofouling Control*, Ann Arbor Science Publishers Inc., 1980.

F. Stegelman, et al., "On line mechanical cleaning of heat exchangers," *Hydrocarbon Processing*, Jan. 1983.

Sargent & Lunday, "Performance of Mechanical Sysstems for Condenser Cleaning," Electric Power Research Institute, Project 2300–11, Jan. 1987.

*Primary Examiner*—Leonard R. Leo

*Attorney, Agent, or Firm*—Alexander D. Ricci; Steven D. Boyd

[57] ABSTRACT

Apparatus and method are provided for on-line cleaning of the tubes of a heat exchanger. Tube cleaners are comprised of two members, a rigid flotation member and an elastomeric cleaning member. The cleaner has a selected density to allow uniform distribution through the tubes and to allow recovery by surface extraction or by strainers. Pressures as the cleaner enters or flows along a tube may be measured and selected.

15 Claims, 6 Drawing Sheets

FIG. 2
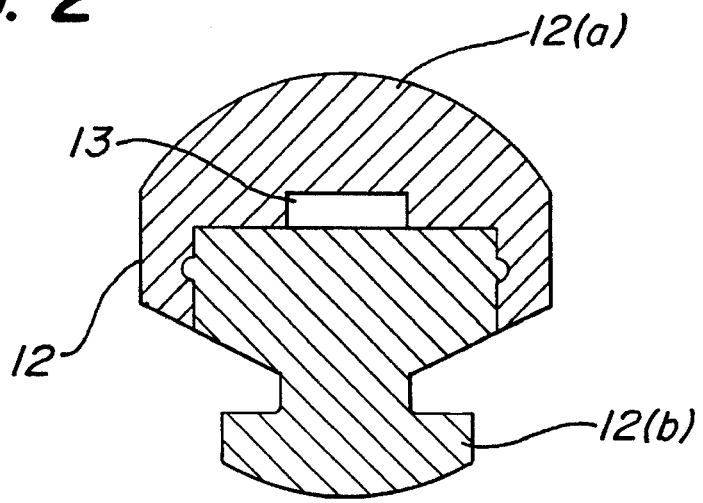
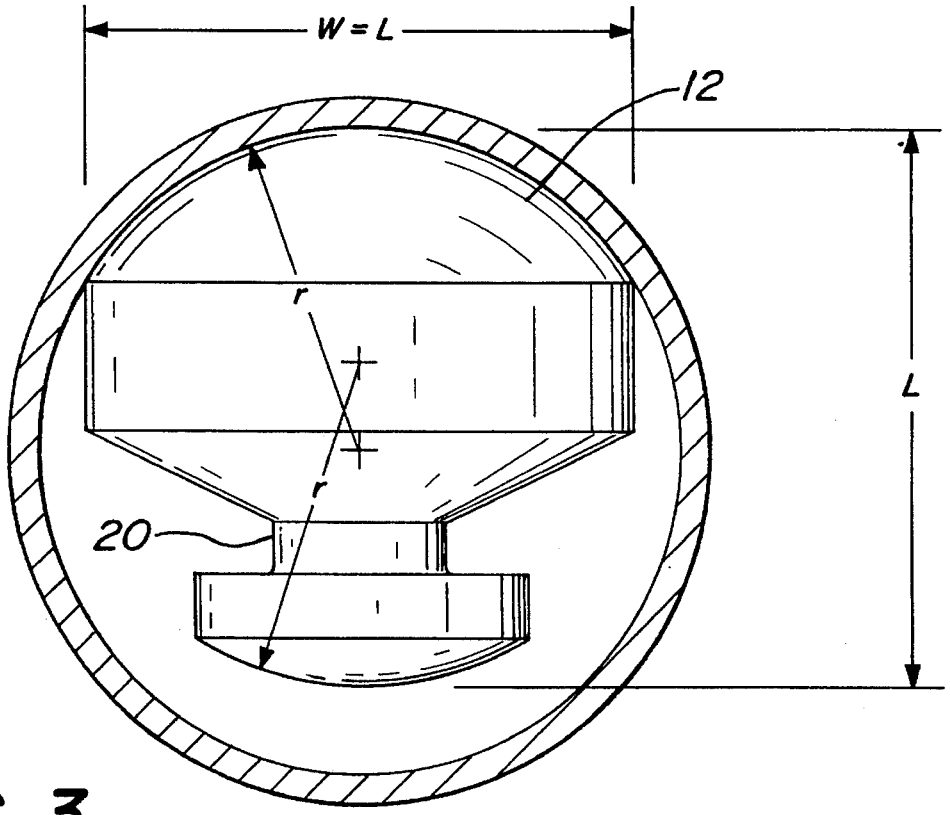
FIG. 3

METHOD AND APPARATUS FOR CLEANING TUBES OF HEAT EXCHANGERS

BACKGROUND OF THE INVENTION

1. Field of the Invention

This invention relates to the cleaning of tubes in heat exchangers. More particularly, a two-member cleaning device having an effective range of properties is provided to be pumped through the tubes while the heat exchanger is on-line.

2. Description of Related Art

Electrical power generation plants use steam-driven turbines to drive the electrical generators. A heat source, either a fossil fuel or a nuclear reactor, is used to produce the steam. The steam, after it has passed through the lowest-pressure turbine, is condensed in the shell of a tube-and-shell heat exchanger by cooling water passing through the tubes. The efficiency of heat removal from the steam by the cooling water determines the back-pressure at the low-pressure turbine exhaust, and this pressure significantly affects the total energy extracted from the steam. Since fuel costs represent approximately 95% of the total production cost of electricity, energy lost by not extracting energy from the steam leads directly to an increase in power cost.

Steam condensers in power plants contain thousands of thin-walled tubes for heat transfer. For example, in one 750 megawatt lignite-fired unit, the steam condenser contains 28,512 1-inch stainless steel tubes. Water flows through the heat exchanger at a rate of about 488,000 gallons per minute. In some steam condensers the tubes are made of a copper alloy.

To maintain maximum heat transfer efficiency, it is necessary to minimize build-up of a film, which decreases heat transfer, on the internal surface of the tubes of the heat exchanger. Techniques have been developed to remove films, at least to some degree, by periodically passing "tube cleaners" through the tubes while a heat exchanger is on-line. Ideally, the tube cleaners will circulate through all tubes at about the same frequency. In other words, the distribution of cleaners over the many tubes should be uniform.

While the discussion of heat exchangers, cooling water and cleaning of heat exchangers will be centered on steam condensers in power plants, it should be understood that the same problems with maintaining clean tubes in heat exchangers occur in other industries, such as the petroleum refining, petrochemical and chemical industries. The article "On-Line Mechanical Cleaning of Heat Exchangers," published in *Hydrocarbon Processing,* January 1983, describes mechanical cleaning of heat exchangers used in the refining industry.

The cooling water in heat exchangers may be contained in a closed system, where the water is air-cooled and recirculate back through the heat exchanger, or it may be drawn from fresh-water lakes or the sea. In some power plants the water is drawn from a fresh-water lake which is connected to the power plant through canals. The rate of fouling of condenser tubes by the water will vary greatly depending on whether conditions are conducive to growth of organisms and whether the chemical composition of the cooling water is such that chemical scales or deposits can form under conditions in the tubes. Biological fouling in steam condensers is commonly caused by bacteria and algae. Common chemical scales causing fouling include calcium carbonate, calcium sulfate, silica and manganese. Electrical utilities have found that chemicals such as chlorine can be used to decrease biofouling and scale inhibitors can be used for chemical scales, but environmental concerns limit the use of chemicals and make it especially important to find improved mechanical cleaning systems which can be used to at least supplement and, preferably, to supplant chemical methods.

There are two types of cleaning systems for the tubes of heat exchangers. Many patents and publications describe various mechanical devices and systems for off-line cleaning, i.e., cleaning the tubes when the heat exchanger has been placed out of service. Fouling occurs at such a rate in many heat exchangers, however, that an on-line system for cleaning is desirable. It is not possible in these instances to maintain high efficiency heat transfer without some form of control of fouling between shut-downs of the unit.

U.S. Pat. No. 5,083,606 discloses an endoscopic method of examination of condenser tubes while on-line and provides a good review of the components of a steam-electric plant, steam condensers and fouling of condenser tubes.

The installation of automatic on-line mechanical cleaning in power plants as early as 1966 in the U.S. has been reported in Chapter 2 of "Condenser Biofouling Control Symposium Proceedings," Ann Arbor Science Publishers, Inc., Ann Arbor, Mich., 1980. The performance of prior mechanical systems for condenser cleaning has been reviewed in a report of the Electric Power Research Institute, "Performance of Mechanical Systems for Condenser Cleaning," EPRI CS-5032, January 1987. The two common types of on-line cleaning bodies are sponge rubber balls (used in the Taprogge system, in which the balls are continuously circulated through tubes of heat exchangers, which is used in about one-third of North American installations) and brushes. In any type of on-line system, it is necessary to have a mechanism for removing the cleaning bodies and recirculating them back through the heat exchanger tubes.

Sponge rubber tube cleaners are used by injecting the cleaners into the cooling water upstream of a heat exchanger and removing them downstream of the heat exchanger by a strainer. A pump is used to recirculate the cleaners back to the inlet of the heat exchanger. The density of the foam rubber balls is designed to be near that of the cooling water, such that separation of the balls from the water flow in the "water box" at the inlet to the heat exchanger tubes will be minimized. Contamination of the foam rubber balls by silt or other solid materials is known to increase the density and may affect the performance of such cleaners, however.

The requirements for on-line and off-line tube cleaners are quite different. Off-line cleaners can be placed in and forced through individual tubes. Ability to enter a tube and be evenly distributed to all the tubes of a heat exchanger from a flowing stream is not a requirement. Also, the pressure required to push an off-line cleaner through the tube is not limited to the operating pressure drop of the heat exchanger. For example, U.S. Pat. No. 3,939,519 proposed a cleaning plug which includes an elongated core body and a plurality of spaced scraper discs along the body. This cleaning body is not suitable for on-line cleaning, because it would not enter a tube from a flowing stream and would require excessive pressure to force the cleaner through a tube.

During operation of cooling water systems, debris may accumulate in the system. This debris may be a small object such as an aquatic plant or animal or a remnant of the construction material of the system, for example. It is desirable that tube cleaners be able to pass through a tube even when small items of debris are present. This is a consideration in determining the optimum size of a tube cleaner.

For the tube cleaners to be re-circulated through the tubes while on-line, it is necessary that the entry pressure of a tube cleaner into a tube not be excessive. If the entry pressure is excessive, the tube cleaners will accumulate in the manifold or water box upstream of the tubes and this could cause restricted flow through the heat exchanger. After a tube cleaner begins flowing through a heat exchanger tube, it is also important that the pressure required to drive the tube cleaner through not be excessive. Excessive pressure drop would increase the probability that a tube cleaner would become stuck and plug a tube, thereby decreasing the efficiency of the heat exchanger. Some pressure drop is required, however, to ensure that the cleaner is contacting the walls of the tube and applying mechanical force to remove any film material present on the surface of the tube.

On-line tube cleaners are designed to be re-circulated many times through a heat exchanger. Each time they are subject to damage by the pump, to frictional wear, and to flexure. Therefore, high-impact toughness and resistance to abrasion are important properties of a hard-body tube cleaner. Resistance to failure upon repeated flexure is important for any flexible component.

With all types of on-line cleaners, means for removing the cleaners from the stream downstream of the heat exchanger is required. The patent literature for devices to strain or screen the cleaners from a liquid stream is extensive. When the sponge ball cleaners are used, it is necessary that the screen devices have narrow spacing, to assure that the cleaners will not deform and flow through the screen. This narrow spacing significantly increases pressure drop through the screen. There is need for a hard-body cleaner which can be removed from screens having wider spacing.

U.S. Pat. No. 4,569,097 discloses variable density or constant density tube cleaners for on-line use which have substantially neutral buoyancy in cooling water when it enters a heat exchanger. Upon exiting from the heat exchanger tubes, the variable-density tube cleaners return to either positive or negative buoyancy. Skimmer means intercept tube cleaners having positive buoyancy from the upper portion of flow in an open once-through water system. The tube cleaners are re-circulated through the tube bank repeatedly. Constant-density tube cleaners having a flotation member and a cleaning member are disclosed in FIG. 17 of the patent. The flotation member and cleaning member are proportioned to provide for approximately neutral buoyancy in the cooling liquid. The material from which the flotation member is to be formed is not specified. The cleaning member is of an elastomer of high abrasion resistance and high flex failure resistance, such as polyurethane. The cleaning member may be fastened to the flotation member by a molded retaining means integral with the flotation member. The flotation member is a sphere and has a diameter less than the inside diameter of a tube which is to be cleaned. The cleaning member is a disk which has a greater diameter than the inside diameter of the tube, such that the cleaning member provides a wiping motion of its periphery against the inside diameter of a tube as a pressure difference pushes the cleaner through the tube. The cleaning member has deformability such that it forms a "cup" upon entry into a tube and the material and diameter of the cleaning member are selected so that the cup "wobbles" in it travels through a tube.

U.S. Pat. No. 4,696,318 discloses a washing system for removing and cleaning floating tube cleaners of the type disclosed in U.S. Pat. No. 4,569,097 from a body of water.

Tube cleaners having a constant density for on-line cleaning of the tubes of heat exchangers are needed which will be recoverable either by a strainer or by surface collection, can be re-circulated many times through pumps and tubes without failure, will evenly distribute over the tubes of large heat exchangers for uniform cleaning of all tubes, will not become lodged in a tube, will clean effectively, will have a density selected to afford recovery from water by surface collection if desired and will be economical to construct.

SUMMARY OF THE INVENTION

A two-member tube cleaner is provided, consisting of a flotation member and a cleaning member. The flotation member is rigid and is sized to pass through tubes of a heat exchanger while supporting an elastomeric cleaning member in the form of a disk. The thickness of the disk is from about 0.045 to about 0.10 inches. Density of the flotation member and the cleaning member are selected to form a tube cleaner with a specific gravity with respect to the cooling fluid in the range from about 0.90 to about 1.1, and preferably in the range from about 0.93 to about 1.05.

In one embodiment, the flotation member is made of high molecular weight polyethylene. In another embodiment the flotation member is made of polypropylene. In either case, the members may be injection molded. In another embodiment, voids are incorporated into a flotation member, which may be plastic or metal.

In some embodiments, the cleaning member is polyurethane having a range of desired dimensions and physical properties.

In still other embodiments, flowing pressure drop across the cleaner, as measured in apparatus simulating flow in the heat exchanger tubes to be cleaned, is in the range from about 5 per cent to about 80 per cent of the operating pressure drop across the heat exchanger containing the tubes to be cleaned. Entry pressure and break-away pressure are measured and selected to be in prescribed ranges of pressure.

A method is provided for cleaning the tubes of a heat exchanger by injecting the tube cleaners and recovering the tube cleaners for re-cycling. In one embodiment the tube cleaners are recovered by surface extraction. In another embodiment, the tube cleaners are recovered by a strainer or screen.

DESCRIPTION OF THE FIGURES

FIG. 2 shows the components of the flotation member of one embodiment of this invention.

FIG. 3 shows the geometrical parameters of the flotation member of one embodiment of this invention.

DETAILED DESCRIPTION OF THE INVENTION

Figure 1:
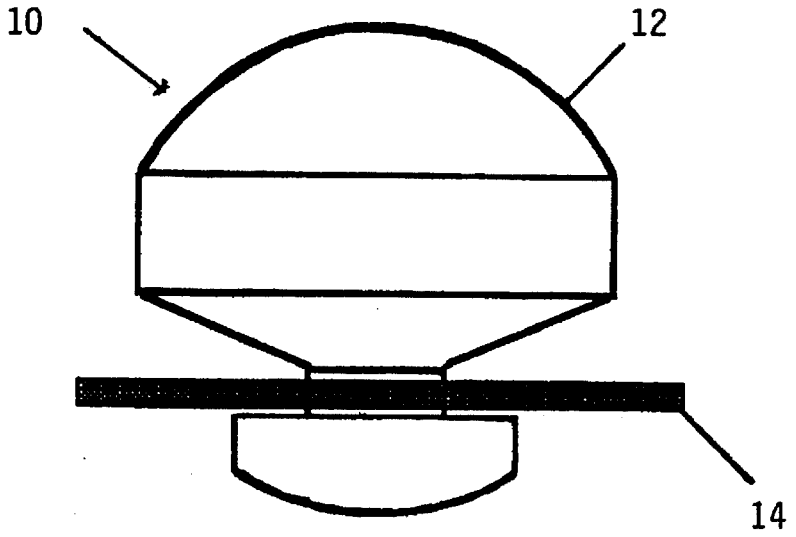
FIG. 1(*a*) and 1(*b*) shows the members of one embodiment of this invention.
Figure 1:
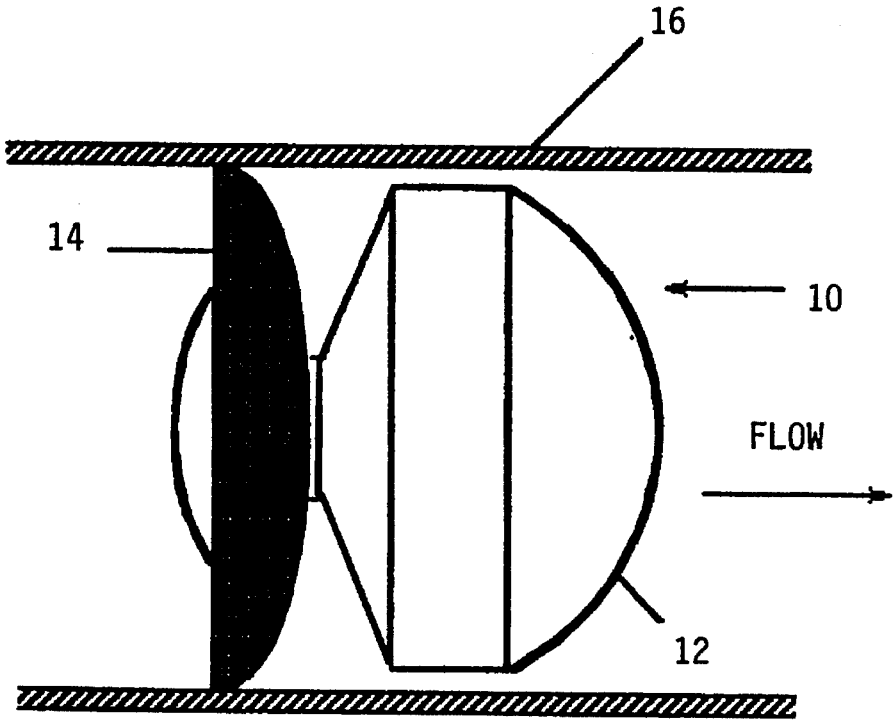

Referring to FIG. 1(*a*), a two-member, constant density tube cleaner 10, is shown. The members are flotation member 12 and cleaning member 14. The material of flotation member or body member 12 is preferably ultra-high molecular weight polyethylene or polypropylene. The polyethylene preferably has a molecular weight between about 3 million and 6 million. The high molecular weight provides increased abrasion resistance, high impact toughness, good corrosion resistance and good environmental stress-crack resistance. Abrasion resistance and impact toughness are particularly important for such tube cleaners, as they may by re-circulated through pumps and tubes several hundred thousand times. Impact toughness is particularly important when the bodies pass through a pump. Flotation member 12 may be injection molded. Ultra-high molecular weight polyethylene has a density from about 0.930 to 0.945 gm/cc.

Another suitable material for body member 12 is polypropylene. The lower specific gravity of this material is an advantage when using higher density cleaning members. Polypropylene has good thermal and mechanical properties and other favorable characteristics; however, it is not as resistant to impact as is polyethylene. It may also be injection molded. The density of polypropylene is about 0.90 to 0.91 gm/cc.

Density of the material of the flotation member can be varied by adding a filler or including voids in the body of the member. A suitable filler for increasing density is silica or glass particles, but many other types of particles are suitable. A suitable filler for decreasing density is hollow microspheres made of glass, ceramics, resins or other materials.

Density of a flotation element made by injection molding may also be reduced by natural voids formed during the molding process. Elements having the desired density can be separated by known techniques of density separation in liquids of different density.

Flotation member 12 may also be constructed from two or more component parts which are adapted to seal together to form the member with air or a solid of selected density in the interior of the member, such as shown in FIG. 2. Flotation member 12 is formed from components 12(*a*) and 12(*b*), with volume 13 in one of the components, such as component 12(*a*). The components of flotation member 12 may be made of high-density polyethylene, for example, in a configuration suitable for snapping the two components together to form a flotation member. The components of flotation member 12 may also be constructed of a metal, such as stainless steel, which will be useful in applications at high pressure or in a cooling fluid which has deleterious effects on polymeric materials. The metal components may be sealed together by techniques well known in industry.

Cleaning member 14 of FIG. 1 is an elastomeric material which serves two functions. First, the elastomeric material does the actual cleaning by making physical contact with the inside tube surface. Secondly, it provides a seal or partial seal against the tube wall and allows the cleaning member to be forced by fluid pressure down the heat exchanger tube.

A suitable elastomeric material of cleaning member 14 is polyurethane. A preferred material is a polyurethane formulation of ESCO Plastics of Houston, Tex., Product No. E 1494. This material has excellent resistance to swelling in an aqueous system, high abrasion resistance, and high flexure fatigue resistance. The material is spin cast into sheets having the thickness desired, to a tolerance of about 0.002 inches, and having a hardness, as measured by a durometer, of 60 Shore A, + or −5, as measured by the ASTM test. Disks are cut from cast sheets of the polyurethane having a thickness in the range from about 0.045 inch to about 0.085 inch which possess the stiffness required for the cleaners of this invention. The manufacturing process for the polyurethane sheets from which the disks are cut lends itself to the addition of other materials such as silicon carbide powder for added abrasiveness or silica powder to increase specific gravity. A dye may also be added to color-code different types of cleaning members. Other types of elastomers suitable for a cleaning member include rubbers and block copolymers having the properties described above.

In FIG. 1(*b*) tube cleaner 10 is shown oriented as it would flow down heat exchanger tube 16. Cleaning member 14 is now flexed to conform to the inside diameter of the tube and is exerting force against the wall of the tube to remove solid materials accumulated thereon.

It has been found that there are preferred dimensions of flotation member 12 of cleaning body 10. FIG. 3 shows flotation member 12 adapted to receive an elastomeric disk or cleaning member on to neck 20. It has been found that the width W of cleaning body 12, preferably about equal to its length, L, should be less than the inside diameter of the tube to be cleaned by a selected distance. In plant operation, a small but finite fraction of cleaning members 10 will be damaged or broken during use. This may release cleaning members which may then be present within a tube. Since cleaning members are lost in the practice of applying the apparatus of this invention in cleaning heat exchanger tubes, width W should preferably be less than the inside diameter of the tube to be cleaned by a distance at least as great as the thickness of the cleaning member to be used. This clearance between flotation member 12 and the inside diameter of a tube also allows for the presence of other small debris in the tube as well as for the presence of loose cleaning members. Although a clearance of at least about the cleaning member thickness is preferred, the clearance may range from about 1 time the thickness of the cleaning member to about 3 times such thickness.

The radius of curvature of the surfaces of the cleaning body is preferably approximately the radius of the inside of the tube to be cleaned. Under these conditions, if a cleaning member is missing from a body, the body will pass through the tube to be cleaned and pass any small obstructions regardless of the orientation of the body.

The diameter of the neck 20 of flotation member 12 is selected to have sufficient mechanical strength to allow low probability of breaking during passage of the tube cleaner through pumps or other mechanical equipment and to allow elastomeric cleaning members to be retained. The diameter of the neck may be in the range of about ¼ the diameter of the tube and the diameter of the enlarged portion beyond the neck may be about ½ the diameter of the tube.

Figure 4:
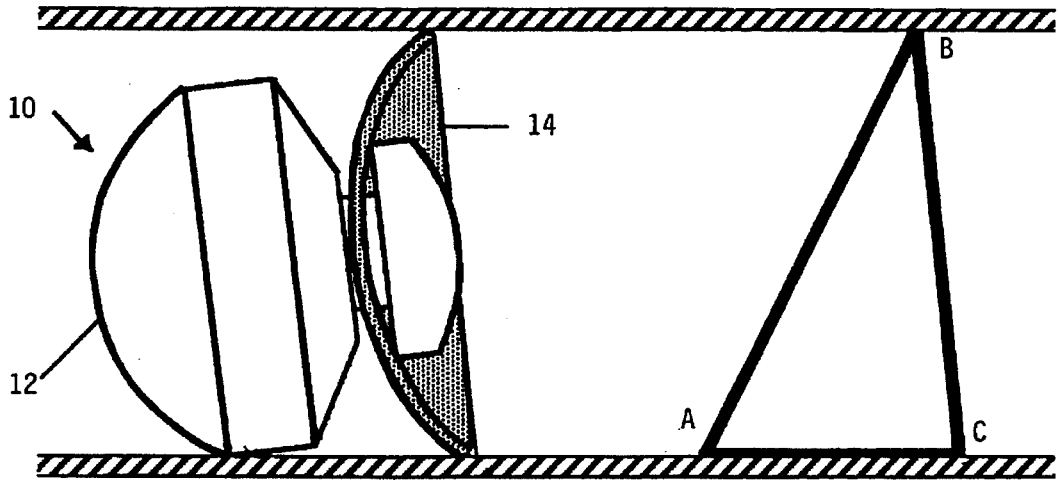
FIG. 4 illustrates limitations of geometrical parameters.

FIG. 4 illustrates limitations on the geometry of the members of tube cleaner 10 such as shown in FIG. 1 and the mechanical properties of cleaning member 14. The orientation of a tube cleaner is illustrated by the triangle ABC, where A is the point where the tube cleaner flotation member comes in contact with the tube wall. B and C represent the cleaning member contacts. For a given tube internal diameter, an optimum dimension of cleaning member 14 will be selected for a given set of conditions. As the angle of cleaning member 14 approaches 90° to the axis of the tube, side AC increases and side BC approaches the tube diameter. Side BC is preferably large enough to form a complete seal with the tube when point A is in contact with the tube wall.

Side AC should be short enough to allow for maximum clearance when the cleaner enters a tube, but long enough for good orientation. If the diameter of cleaning member 14 is excessively large and the member is not sufficiently flexible, a limitation in ability to cause the member to enter a tube will arise. Also, should cleaning member 14 have excess size and stiffness, the pressure required to flow the member down a cleaning tube will be excessive.

Figure 5A:
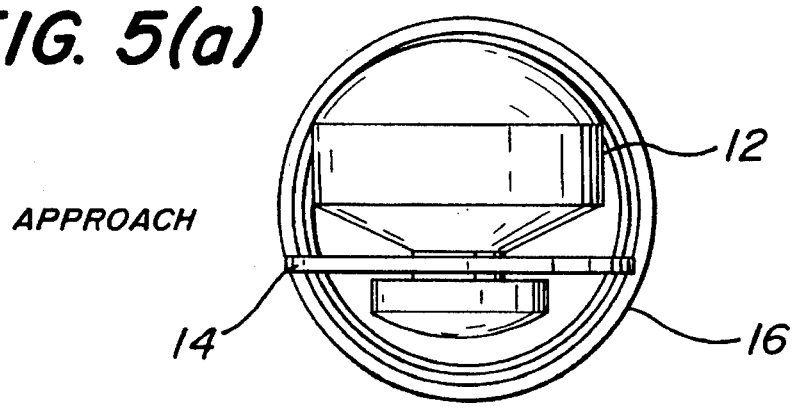
FIG. 5(*a*), 5(*b*) and 5(*c*) illustrates change of orientation of a cleaner entering a heat exchanger tube.
Figure 5B:
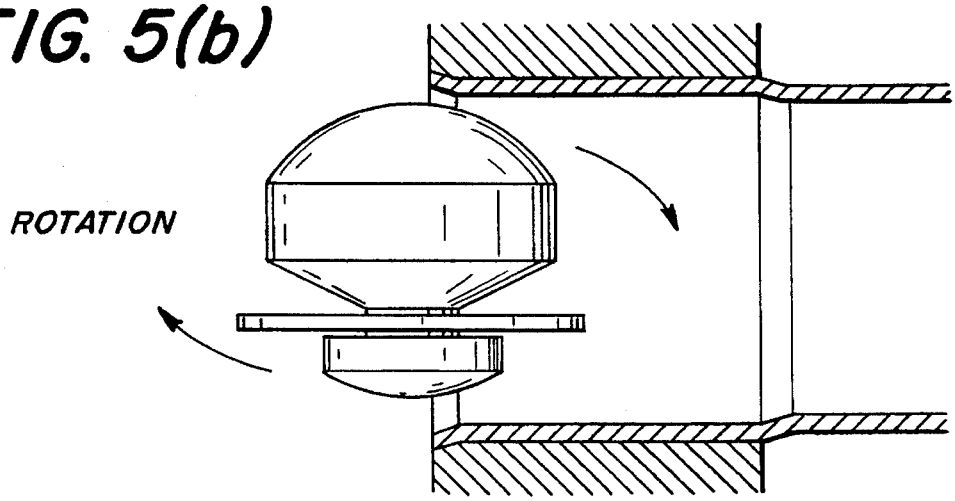
Figure 5C:
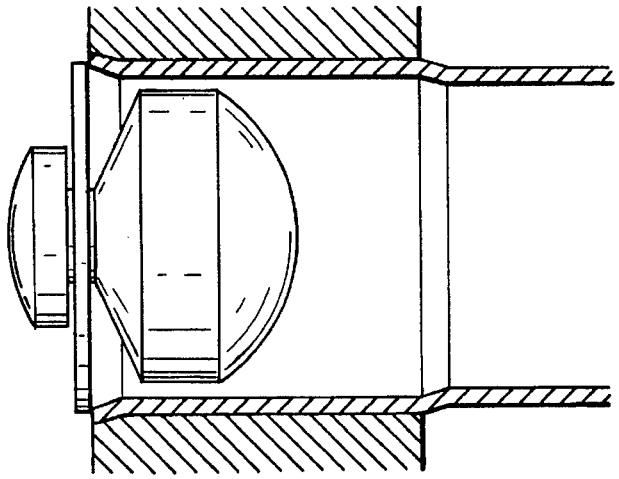

The effects of the dimensions and physical properties of cleaning member 14 on the ability of the cleaning body to enter tube 16 is illustrated in FIG. 5. In FIG. 5(*a*), the tube cleaner is approaching tube 16 in its most probable orientation, with flotation member 12 upward, although, because of turbulence in the flow stream, orientation could be in any direction. Cleaning member 14 is larger in diameter than the entrance to tube 16 and will provide an anchor to cause the cleaner to rotate, as shown in FIG. 5(*b*). The cleaner then is in position to enter the tube, as shown in FIG. 5(*c*). The pressure required to cause the cleaner to enter the tube is defined as the "entry pressure." The pressure required to force the cleaner through the tube after it has entered is called the "flowing pressure drop." If movement of a cleaner through a tube is stopped and started again, the pressure required to initiate movement is called the "break-away pressure."

Figure 6:
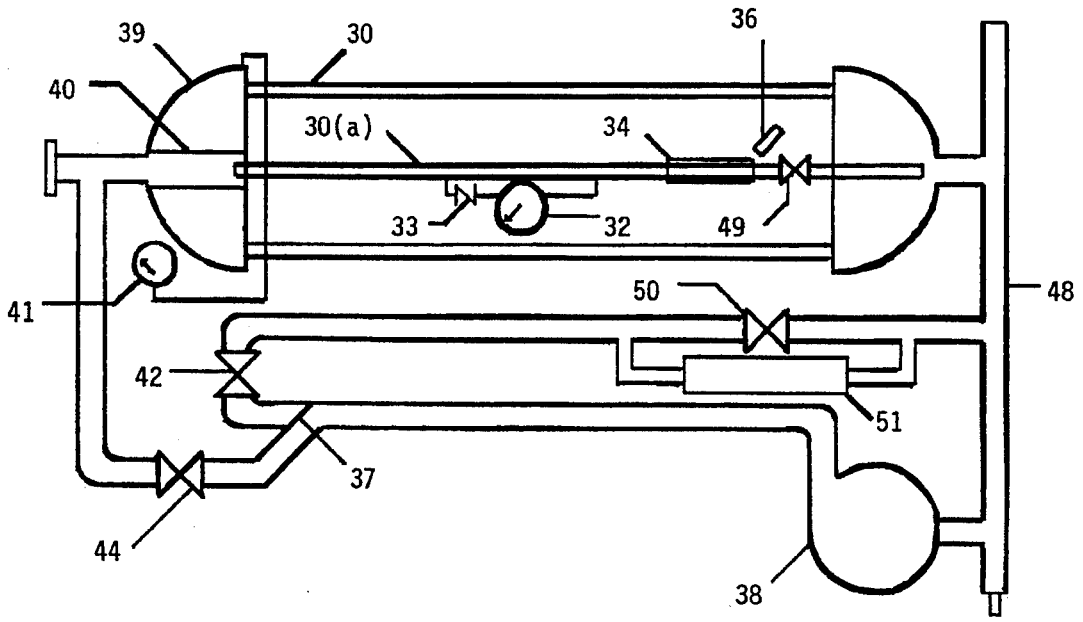
FIG. 6 is a sketch of apparatus used for determining the limitations of cleaners of the type to which this invention applies.

FIG. 6 shows test apparatus suitable for determining pressure parameters of tube cleaners of this invention. This apparatus comprises a tube having the inside diameter of the tubes in the heat exchanger that is to be cleaned with tube cleaners of this invention. A plurality of tubes such as tube 30 may be arranged in parallel with tube 30(*a*), which is the tube for testing and which is instrumented to measure pressure gradient along the tube. The length of the tubes should be great enough to avoid end effects and to allow pressure measurements with available pressure gauges. A length of 20 feet is suitable.

Tube 30(*a*) has differential pressure gauge 32 along a segment of the tube. The segment may be about 2 feet, with check valve 33 upstream from gauge 32 so as to trap the maximum differential pressure reading on gauge 32 as a tube cleaner passes through tube 30(*a*). Sight tube 34 with optical counter 36 detects the passage of a tube cleaner through tube 30(*a*) and counts the number of passes. Centrifugal pump 38, preferably having a recessed impeller, circulates water and tube cleaners through the system. Inlet manifold 39, simulating an inlet water box in a steam plant condenser and preferably being transparent, directs water into tube 30(*a*) and any parallel tubes. Cage 40, projecting into inlet manifold 39, directs tube cleaners into tube 30(*a*).

The rate of water flow supplied by pump 38 to the tubes is controlled by two full-port ball valves, 42 and 44. Maximum pressure control valve 42 either directs the total flow from pump 38 through the tubes, or, if this valve is in the full open position, directs water through by-pass line 46. By control of pump 38 or by control of valves 42 and 44, or by control of both the pump and valves, it is preferable that pressure differential along the length of tube 30(*a*) be controllable at least from about 1.5 psi pressure drop across a 20-ft long tube, which is in the range of normal operating conditions in some power plant steam condensers, to about 8 psi across a 20 foot long tube, which is in the range of normal operating conditions of pressure gradient in other heat exchangers. Total pressure drop across the tubes should also be controllable down to values which are less than 80 per cent of the total pressure drop across the heat exchanger to be cleaned. Minimum pressure control valve 44 can be used to decrease pressure drop across the tube bundle to low values before partially closed ball valve 44 restricts passage of a tube cleaner.

The tube cleaners to be tested are introduced to the tubes through vertical stand-pipe 48 leading to the suction of pump 38. After passing through pump 38, a tube cleaner is routed to inlet manifold 39 by a "Y" strainer 37, which allows tube cleaners to be diverted through valve 44 while circulating water passes through the strainer and valve 42. A tube cleaner enters center tube 30(*a*) and may make a single pass and go back to pump 38. A complete circuit may take about 7 seconds. With continual pumping, a tube cleaner may be re-circulated through the tube for hundreds or thousands of passes during a test. Temperature of the water during circulation may be controlled by valve 50, which can be used to divert water through radiator 51 for cooling.

One of the primary measurements made during a test with the test equipment of FIG. 5 is the flowing pressure drop of a tube cleaner. This measures the amount of energy consumed by the tube cleaner's frictional drag, or the force applied to clean the tube. Flowing pressure drop may be measured by re-circulating a tube cleaner through tube 30(*a*) under constant flow conditions. Pressure gauge 32 increases to a constant value after a small number of passes of the tube cleaner, which is the flowing pressure drop. Alternatively, an electronic pressure gauge having rapid response can be used in place of gauge 32 and the instantaneous maximum pressure as a tube cleaner passes can be recorded electronically. Preferably, flowing pressure drop in tube 30(*a*) should be in the range between about 5 per cent and about 80 per cent of the total operating pressure drop across the heat exchanger tubes to be cleaned. Above 80 per cent the cleaner is moving too slowly and has increased risk of stopping in a tube, and below 5 per cent the cleaner is not providing sufficient cleaning action.

Other design parameters measured by the test apparatus of FIG. 5 are entry pressures and "break-away" pressures. Entry pressure is defined as the amount of pressure required to engage or orient a tube cleaner in a tube. This parameter is measured by closing valve 49 on tube 30(*a*) downstream of sight tube 34 and trapping a tube cleaner in cage 40. Minimum pressure control valve 44 is closed while valve 49 in tube 30(*a*) is opened. A tube cleaner is then floating in the water in cage 40. Control valve 44 is slowly opened allowing water into tube 30(*a*) and the tube cleaner is carried to the entry to tube 30(*a*). Pressure gauge 41 mounted on inlet manifold 39 measures the pressure at the inlet. As water flow increases, pressure drop across the tube increases, forcing more water through the tubes. As pressure increases, the tube cleaner is rotated into the tube opening, which can be observed through the transparent cover to inlet manifold 39. Once the tube cleaner is engaged and orientation is completed, entry pressure as measured on gauge 41 is recorded. A low entry pressure is desirable. The entry pressure must be less than the normal total pressure drop across the tubes of the heat exchanger to be cleaned and is preferably less than about 50 per cent of this value.

"Break-away" pressure is the pressure required to move a tube cleaner from a dead stop in the tube. This parameter becomes important if a circulating water pump is shut-down in a power plant while a tube cleaner is in a tube. When the pumps resume operation, a tube cleaner should be able to move out of the tube. It is measured by stopping flow through tube 30(*a*) with a tube cleaner in the tube and gradually increasing pressure, as determined by gauge 41, until the tube cleaner begins to move. The maximum pressure measured is the break-away pressure. The limit of preferable break-away pressure is the same as that for entry pressure.

Numerous measurements of pressure drop across the tube of FIG. 6 as a function of diameter and thickness of cleaning member 14 of FIG. 1 and different diameters of flotation member 12 of FIG. 1 showed that the diameter of cleaning element 14 should be in the range of size from diameter equal to tube inside diameter to about 0.10 inch greater than inside diameter, with a cleaning element thickness between about 0.045 and about 0.085 inches. Preferably the diameter of the cleaning element is from about 0.020 inch to about 0.065 inch greater than inside diameter of the tube to be cleaned and the thickness of the cleaning element is from about 0.050 to about 0.070 inch.

Figure 7:
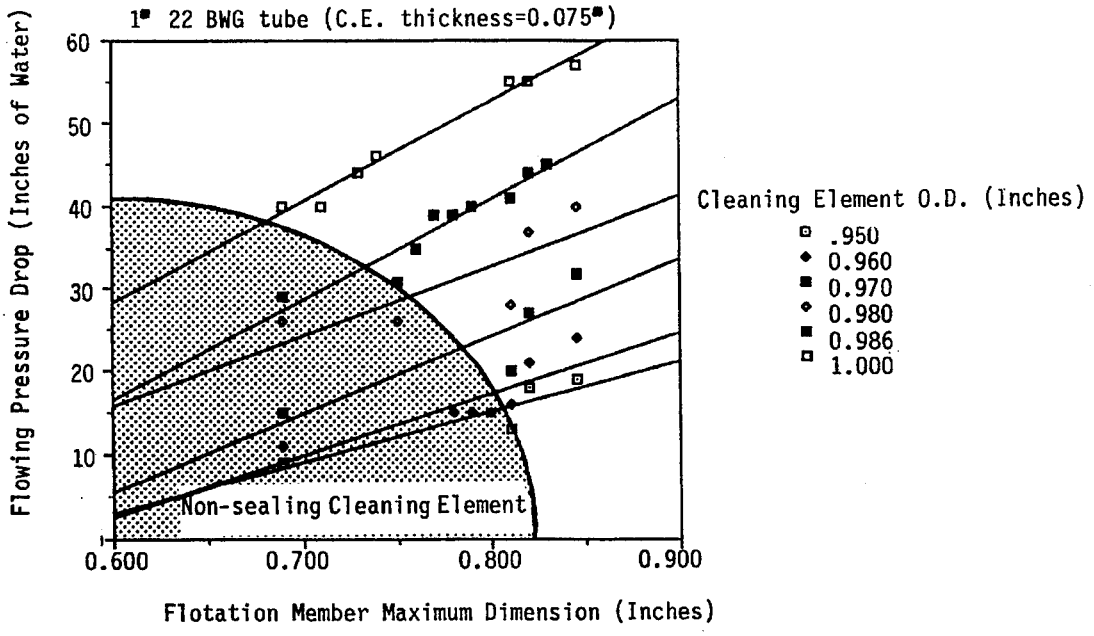
FIG. 7 shows the effect of flotation member maximum dimension on flowing pressure drop for cleaning members of various outside diameters.

The data above are applicable to cleaning body diameters of 0.7–0.9 inch and 1-inch 22 BWG gauge tubes, which have an inside diameter of 0.944 inch. There is an effect of cleaning body diameter on flowing pressure drop, as shown in FIG. 7. Body diameter also determines if the sealing element forms a complete seal around the periphery of the tube. Non-sealing cleaning element diameters, as calculated from the triangle of FIG. 4, are also shown in FIG. 7. Body diameter must be greater than 0.7 inches to obtain a seal of the cleaning member when the cleaning member diameter is 0.95 inch in a tube with inside diameter of 0.944 inch. The relationship between flowing pressure drop and body diameter is not significantly affected by whether the cleaning element is sealing in the tube.

There is also a density requirement to be satisfied by the tube cleaners of this invention. If the cleaners are to be recovered using conventional Taprogge-type screens, the cleaners should be fabricated to about neutral buoyancy at conditions of temperature and salinity in the inlet manifold of a heat exchanger. This can be done by: determining the density of the cooling water under conditions in the inlet water box using published data on the density of water and aqueous solutions at different temperatures and salinities, determining the volumes of the flotation member and cleaning member, determining the material of the cleaning member, and selecting the material of the flotation member from among materials described above to provide an average density of the two members approximately the density of the cooling water. The density of water may vary as much as about 3 per cent at different seasons of the year, because of temperature and salinity variations, so an average density over the year may be used when selecting average cleaner density.

It is convenient when establishing density requirements of tube cleaners to use "relative specific gravity" of the tube cleaners. This is defined as the specific gravity with respect to the cooling water or fluid at the temperature of interest. Using this definition, the value of the relative specific gravity of the cooling fluid is 1.000 at any temperature. The common temperatures of tube cleaners used in electrical power plants are in the range from about 40° F. to about 125° F.

When the tube cleaners are to be separated by surface collection, the relative specific gravity of the two-element cleaner will be selected to be less than 1.0 under conditions where surface collection will occur, but not less than about 0.95 under temperatures at the inlet manifold. Tube cleaners can be recovered for re-cycling by surface collection when density is reduced to less than this low-density limit, but it has been found that lower density also leads to failure of some of the cleaners to be recovered from the heat exchangers and related piping. Therefore, relative specific gravity of tube cleaners for surface collection should be in the range from about 0.93 to about 0.98 at the conditions of surface collection.

For collection of the tube cleaners of this invention by a screen, relative specific gravity in the inlet manifold can be selected to be very nearly 1.0 at the average temperature in the inlet manifold. A range of relative specific gravity from about 0.9 to about 1.1 is acceptable, but the range is preferably from about 0.93 to about 1.05.

Having described the invention above, various modifications of the techniques, procedures, methods, material and equipment will be apparent to those in the art. It is intended that all such variations within the scope and spirit of the appended claims be embraced thereby.

What is claimed is:

1. A unidirectional tube cleaner comprising:

a first end and a second end;

said first end comprising a flotation member having a matrix of rigid material and a maximum dimension, the maximum dimension being less than the inside diameter of the tube to be cleaned by a selected distance, the flotation member having a neck adapted to receive and retain an elastomeric material and having a selected density; and said second end comprising a cleaning member having a matrix of elastomeric material in the form of a disk having a hole therethrough adapted to engage the neck of the flotation member, the disk having a thickness in the range from about 0.045 to about 0.100 inch and a selected density, wherein the density of the flotation member and the cleaning member are selected to form a tube cleaner having a relative specific gravity in the range from about 0.9 to about 1.1.

2. The tube cleaner of claim 1 wherein the matrix of the flotation member is formed primarily from polyethylene.

3. The tube cleaner of claim 2 wherein the polyethylene has a molecular weight from about 3 million to about 6 million.

4. The tube cleaner of claim 1 wherein the matrix of the flotation member is formed primarily from polypropylene.

5. The tube cleaner of claim 1 wherein the selected density of the flotation member or the cleaning member is achieved by means for incorporating therein a material having a density different from the density of the matrix of the member.

6. The tube cleaner of claim 1 wherein the cleaning element is made predominantly of polyurethane.

7. The tube cleaner of claim 6 wherein the polyurethane is selected to have high resistance to swelling in an aqueous fluid, high abrasion resistance and high flexure fatigue resistance.

8. The tube cleaner of claim 6 wherein the polyurethane has a hardness of about 60 Shore Hardness A plus or minus 5.

9. The tube cleaner of claim 1 wherein the disk has a diameter in the range from about the inside diameter of the tube to be cleaned to about 0.10 inch greater than the inside diameter of the tube to be cleaned.

10. The tube cleaner of claim 1 wherein the flowing pressure drop across the tube cleaner in a tube of the inside diameter of the tube to be cleaned is measured to be from about 5 per cent to about 80 per cent of the operating pressure drop across the tubes of the heat exchanger to be cleaned.

11. The tube cleaner of claim 1 wherein the entry pressure of the tube cleaner into a tube of the inside diameter of the tube to be cleaned is less than the operating pressure drop across the tubes of the heat exchanger to be cleaned.

12. The tube cleaner of claim 1 wherein the break-away pressure of the tube cleaner in a tube of the inside diameter of the tube to be cleaned is less than the operating pressure drop across the tubes of the heat exchanger to be cleaned.

13. The tube cleaner of claim 1 wherein the maximum dimension of the flotation member is in the range from about one-half of the inside diameter of the tube to be cleaned to about the inside diameter of the tube to be cleaned less the thickness of the cleaning member.

14. A method of cleaning the tubes of a heat exchanger while cooling fluid is passing through the tubes comprising:

injecting into the stream of cooling fluid upstream from the heat exchanger a unidirectional tube cleaner, the tube cleaner having a first end and a second end, said first end comprising a flotation member having a matrix of rigid material and a maximum dimension, the maximum dimension being less than the inside diameter of the tube to be cleaned by a selected distance, the flotation member having a neck adapted to receive and retain an elastomeric material and having a selected density and said second end comprising a cleaning member having a matrix of elastomeric material in the form of a disk and a hole therethrough adapted to engage the neck of the flotation member, the disk having a thickness in the range from about 0.045 to about 0.100 inch and a selected density, wherein the density of the flotation member and the cleaning member are selected to form a tube cleaner having a relative specific gravity in the range from about 0.9 to about 1.1;

recovering from the stream of cooling fluid downstream of the heat exchanger the tube cleaner; and re-cycling the tube cleaners back to the point of injection into the stream of cooling fluid.

15. The method of claim 14 wherein the tube cleaners are injected into the stream of cooling fluid at a point downstream of a condenser cooling water pump.

* * * * *